United States Patent [19]

Hasegawa et al.

[11] Patent Number: 4,779,328

[45] Date of Patent: Oct. 25, 1988

[54] SHIELDED CABLE, AN APPARATUS FOR AND METHOD OF PREPARING AN END THEREOF

[75] Inventors: Izumi Hasegawa, Yokohama; Kunio Nakamura, Tokyo; Minoru Abe, Kawasaki, all of Japan

[73] Assignee: AMP Incorporated, Harrisburg, Pa.

[21] Appl. No.: 42,144

[22] Filed: Apr. 24, 1987

[30] Foreign Application Priority Data

Apr. 25, 1986 [JP] Japan ..... 61-96599
Apr. 6, 1987 [JP] Japan ..... 62-84509

[51] Int. Cl.[4] ..... H01R 43/04

[52] U.S. Cl. ..... 29/564.4; 29/564.8; 29/759; 29/762; 140/1

[58] Field of Search ..... 29/564.3, 564.4, 564.7, 29/564.8, 755, 759, 762, DIG. 78, 564.1, 421 R; 140/1; 72/54, 56

[56] References Cited

U.S. PATENT DOCUMENTS

| | | | |
|---|---|---|---|
| 3,621,560 | 11/1971 | Le Bright | 30/286 X |
| 4,001,931 | 1/1977 | McKee | 29/866 |
| 4,391,038 | 7/1983 | Greene et al. | 29/564.1 X |
| 4,633,570 | 1/1987 | Burgit et al. | 29/564.4 |

*Primary Examiner*—Gil Weidenfeld

*Assistant Examiner*—Steven C. Bishop

*Attorney, Agent, or Firm*—Adrian J. LaRue; William B. Noll

[57] ABSTRACT

An apparatus for processing the end portion of a shielded cable comprises at least one cable-holding means for holding the shielded cable, a transport means for moving the cable-holding means through various stations, the shielded cable being removed of a predetermined length of its outer insulation jacket beforehand and being clamped in the cable-holding means at a first station such that the exposed portion thereof projects forward compressed air means provided opposite the position at which the exposed portion of the shielded cable stops at the second station for blowing air onto exposed shielding wires so as to separate them into upper and lower rows, a wire-bending means provided opposite the position at which the exposed portion of the shielded cable stops at the third station for straightening and aligning the shielding wires separated by the compressed means and bending the same back over the cable-holding means, and a wire-cutting means provided opposite the position at which the exposed portion of the shielded cable stops at the fourth station for cutting the shielding wires bent back over the cable-holding means.

9 Claims, 8 Drawing Sheets

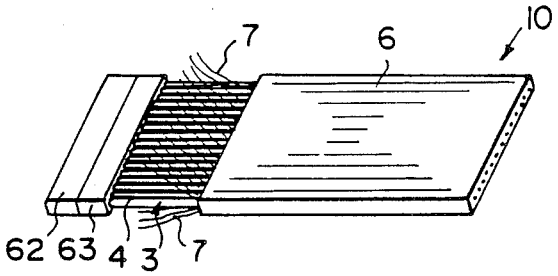
FIG. IE
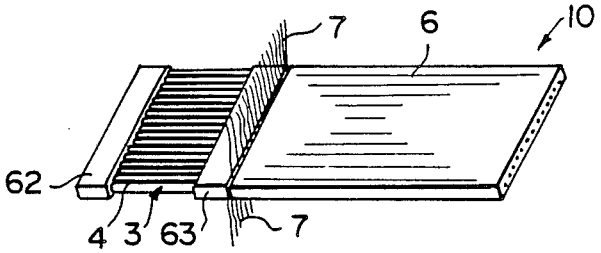
FIG. IF
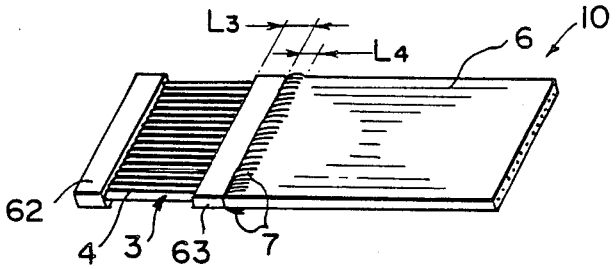
FIG. IG
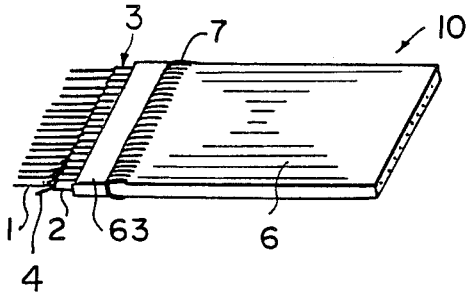
FIG. IH d1
6
10
10a 7
10

2
1
PRIOR ART

SHIELDED CABLE, AN APPARATUS FOR AND METHOD OF PREPARING AN END THEREOF

FIELD OF THE INVENTION

This invention is related to a shielded ribbon coaxial cable and more particularly it is related to a structure of the end portion of the shielded ribbon coaxial cable, an apparatus for and a method of preparation thereof for connecting the prepared cable end to an electrical connector.

BACKGROUND OF THE INVENTION

Cables used, for example, the wiring of a computer are very easily affected by external interference, and the cable is generally shielded. This type of shielded cable, for example, as shown in FIG. 4, comprises a drain conductor 4 arranged at the side of an insulated conductor 3, which includes a signal conductor 1 covered by an insulation sheath 2. The drain conductor is covered with a shield 5 of an aluminum foil, and a plurality of the shielded conductors are arranged in parallel and then integrally covered with an outer insulation jacket 6. The drain conductors 4 are connected with a ground terminal, and therefore, the shield 5 is also connected to ground to protect the signal conductors 1 connected to signal terminals from external interference.

However, in this type of shielded cable, as the shield is made of an aluminum foil, the direct current resistance is comparatively large, and further, the flexibility is unsatisfactory. Accordingly, a shielded cable using a shield of copper wires instead of aluminum foil is being used. As shown in FIG. 5, the shielded cable 10 comprises a plurality of fine copper shielding wires 7 spirally wound around the insulated conductor 3 comprising a signal conductor 1 covered with an inner insulation sheath 2, and a plurality of the shielded conductors 3 wound with the shielding wires 7 defining shielded conductors are arranged laterally in parallel. A drain conductor 4 is arranged at the side of each shielded conductor 3 in electrical engagement with the shielding wires 7 thereof; conductors 3, shielding wires 7 and drain conductors 4 are then integrally covered with an outer insulation jacket 6. The direct current resistance of shielded cable 10 is small, interference is efficiently prevented, and further, the handling of the cable is made easier because of enhanced flexibility.

When using the shielded cable 10 shielded with the spiral wound shielding wires 7, as shown in FIG. 5, an electrical connector is connected with prepared end portions of the cable, and thus a connection between the cable 10 and a mating electrical connector can be readily effected. The following is an explanation of the method of connecting the end portions of the cable 10 with the connector.

FIGS. 6A to 6E successively show the process whereby the signal conductors 1 and drain conductors 4 are exposed at the end portion of the shielded cable 10 and connected with specified terminals of electrical connector 8. First, as shown in FIG. 6A, only the outer insulation jacket 6 is cut at a right angle to the cable axis at a distance d1 from one end 10*a* toward the center portion of the shielded cable 10. Namely, only the outer insulation jacket 6 is cut along the dotted line in FIG. 6A. Next, the cut end portion 10*a* of the outer insulation jacket 6 is removed from the cable, and the spiral wound shielding wires 7 are then unwound and separated into upper and lower rows to allow the insulated conductors 3 and the drain conductors to be exposed as shown in FIG. 6B. Then the shielding wires 7, which have been separated into upper and lower rows, are cut and the remaining ends of wires 7 are bent backwardly over insulation jacket 6 and further, the inner insulation portions 2 are removed to allow the signal conductors 1 to be exposed, as shown in FIG. 6D. Next, each signal conductor 1 is connected with each specified electrical terminal of connector 8, and the drain conductors are also connected with ground terminals of connector 8.

Although the end portion of the shielded cable 10 is connected with the connector 8, the following problems are apt to arise. First, when the spiral wound shielding wires 7 are being unwound as shown in FIG. 6B, there is a possibility that the spacing of each of the conductors 3 and 4 may be changed by fraying of the insulated conductors 3 and the drain conductors 4, and by the conductors 3 and 4 being bent. If the spacing of each of the conductors 3 and 4 is changed, it will not correspond with the spacing of each terminal of the connector 8, and therefore, a problem arises in that it becomes difficult to connect them with each terminal of the connector 8 shown in FIG. 6E. Second, since the spacing of the insulated conductors 3 is small, and the insulated conductors are arranged close together, the spiral wound shielding wires 7 cannot be completely unwound, thus, there is also a possibility that some of the shielding wires 7 may remain between the insulated conductors 3. If some of the shielding wires 7 remain in this position, these remaining shielding wires 7 can contact with the signal conductors 1, which are connected with each terminal of the connector 8, therefore a problem arises in that the signal conductors are connected to ground. Third, although the unwound shielding wires 7 are bent back as shown in FIG. 6C, the shielding wires 7 may spring or move back and make contact with signal conductors 1, therefore, the signal conductors are connected to ground.

SUMMARY OF THE INVENTION

In consideration of the above-mentioned problems, the purpose of this invention to provide a structure of the end portions of the shielding cable, a method of and an apparatus for preparation thereof which eliminates the above-mentioned problems.

An end portion of a shielded cable according to the present invention comprises an insulated conductor exposed at a certain length, an outer insulation jacket covering the insulated conductor is cut at a point from the exposed insulated conductor toward the center portion of the shielded cable in the longitudinal direction, the cut portion of the insulation jacket is moved free of the insulation jacket, and shielding wires are arranged between the cut portion and held between the cut portion and the insulation jacket.

A method of preparing an end of a shielded cable according to the present invention comprises the steps of exposing shielded insulated conductors by removing a certain length of an outer insulation jacket at the end of the shielded cable; unwinding spirally-wound shielding wires covering the outside of each of the exposed shielded insulated conductors, arranging the unwound wires into upper and lower rows, and cutting off the unwound shielding wires; cutting the outer insulating jacket at a right angle to an axial direction thereof at two locations between the end and the center in the longitudinal direction of the outer insulation jacket and separating the outer insulation jacket into a first cut portion which is moved to the ends of the exposed insulated conductors and a second cut portion which is moved adjacent to the first cut portion; shifting the second cut portion of the outer insulation jacket along the exposed insulated conductors in the longitudinal direction of the shielded cable to a position adjacent the insulation jacket to hold the shielding wires therebetween.

In the end portion structure of the shielded cable according to this invention, since the unwound shielding wires are held between the cut portion of the outer insulation jacket and the remaining outer insulation jacket, contact between the shielding wires and signal conductors is prevented.

Also, regarding the preparation of the end portion of the shielded cable, because the second cut portion of the insulation jacket is moved back again after the first and second cut portions of the insulation jacket are first moved to the position adjacent to the ends of the exposed insulated conductors, the shielding wires remaining between the exposed insulated conductors are pushed back toward the center portion of the cable by the second cut portion of the insulation jacket when moved back and are held between the second cut portion of the insulation jacket and the remaining insulation jacket, therefore, no shielding wires remain between the exposed insulated conductors. Also, the first cut portion of the insulation is located at the ends of the insulated conductors thereby maintaining the specified alignment of the insulated conductors.

Also, according to the present invention, an apparatus for processing the end portion of a shielded cable comprises at least one cable holder means for holding the shielded cable, a transport means for conveying the cable holder means through four stations, the shielded cable being removed of a predetermined length of an outer insulation jacket beforehand and being clamped in the cable holding means at the first station such that the exposed elements thereof project forward, a compressed air means provided opposite the position at which the exposed elements of the shielded cable stops at the second station for blowing air onto the exposed shielding wires so as to separate them into upper and lower rows of wires, a wire bending means provided opposite the position at which the exposed portion of the shielded cable stops at the third station for straightening and aligning the rows of shielding wires and bending the same back over the cable holder means, and a wire-cutting means provided opposite the position at which the exposed elements of the shielded cable stops at the fourth station for cutting the shielding wires bent back over the cable holder means.

The aforesaid apparatus makes it easy to automate cable end processing. Moreover, since the processing of the cable is carried out by first separating the exposed shielding wires of the shielded cable into upper and lower rows of wires by blowing air thereon, then bending back the separated shielding wires, and finally cutting them off, little or no bending of the insulated conductors or drain conductors takes place, and few, if any, of the shielding wires remain unwound from the insulated conductors.

The above an other objects, features and advantages of the present invention will become more apparent from the following description when taken in conjunction with the accompanying drawings in which preferred embodiments of the present invention are shown by way of example.

BRIEF DESCRIPTION OF THE DRAWINGS

FIGS. 1A to 1H are perspective views successively showing a method of preparation of an end of a shielded cable according to this invention.

DETAILED DESCRIPTION OF THE INVENTION

Figure 1A:
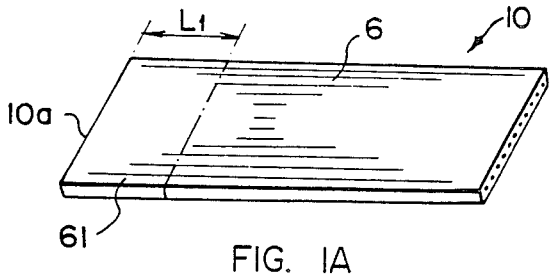
Figure 1B:
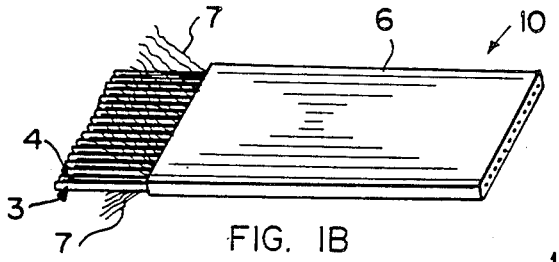
Figure 5:
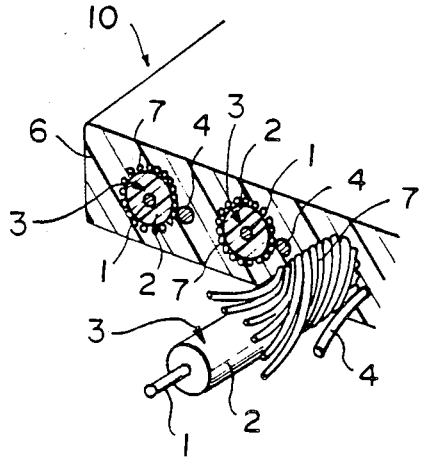
FIG. 5 is a cross-sectional perspective view of the shielded cable of which an end thereof is prepared according to this invention.
Figures 6A, 6B, 6C, 6D, 6E:
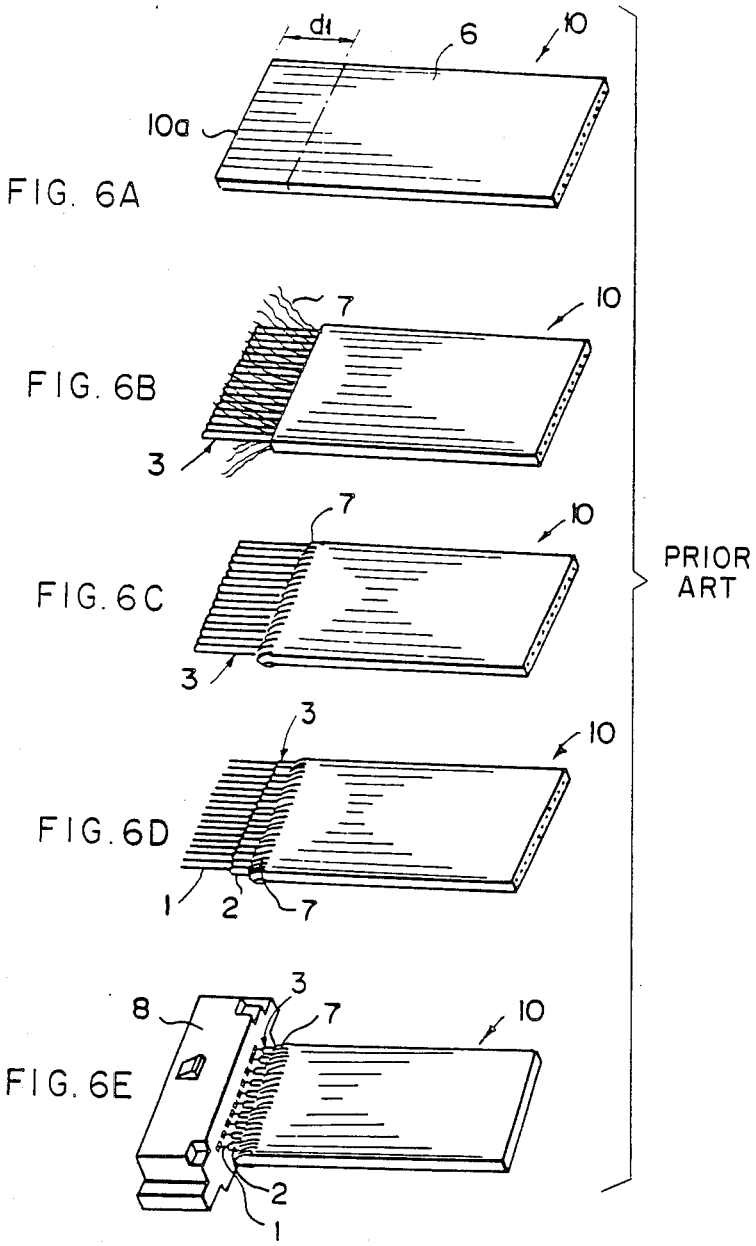
FIGS. 6A to 6E are perspective views successively showing the method of preparing an end of a prior art shielded cable.

FIGS. 1A to 1H successively show a method of preparing an end of a shielded cable according to this invention. First, only the outer insulation jacket 6 is cut at a right angle to the cable axis at a location shown by a dotted line in FIG. 1A from one end 10*a* to the specified distance L1 of shielded cable 10 which is shown in greater detail in FIG. 5. Next, the cut portion 61 of the outer insulation jacket 6 is removed and the spiral wound shielding wires 7 are then unwound and separated into upper and lower rows of wires thereby leaving the insulated conductors 3 and the drain conductors 4 exposed as shown in FIG. 1B. These separated shielding wires 7 are then cut off. A certain length of wires 7 can remain and does not cause a problem. In fact, allowing a certain length of wires 7 to remain enables the operation to be automated.

Figure 1C:
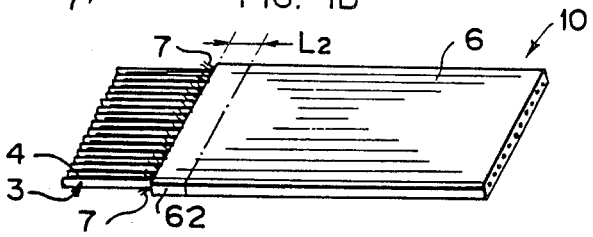
Figure 1D:
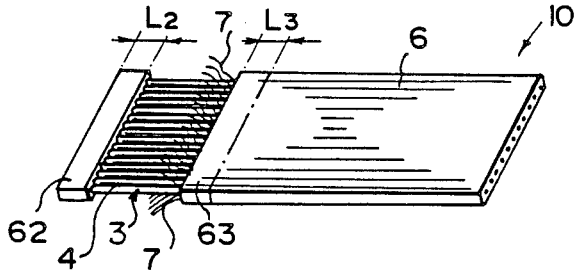

Next, once again only outer insulation jacket 6 is cut at a right angle to the cable axis at a location a distance L2 shown by a dotted line in FIG. 1C from the end. After the outer insulation jacket 6 is cut, the cut portion 62 of the insulation jacket is moved toward the left along exposed conductors 3, 4 and wires 7 as shown in FIG. 1D so that it is located at the ends of conductors 3, 4 and free of wires 7. Next, outer insulation jacket 6 is cut again at a right angle to the cable axis at a location a distance L3 shown by the dotted line in FIG. 1D from the end whereafter the second cut portion 63 of the insulation jacket 6 is moved along conductors 3, 4 and wires 7 and located at a position contiguous to the first cut portion 62 of the insulation jacket free of wires 7 as shown in FIG. 1E. Then, the second cut portion 63 of insulation jacket 6 is moved along conductors 3, 4 back toward the right to a position contiguous to the remaining outer insulation jacket 6. Accordingly, the exposed shielding wires 7 are pushed back by the second cut portion 63 of the insulation jacket and then held between the second cut portion 63 and insulation jacket 6. Further, at this time, any shielding wires 7 remaining between the insulated conductors 3 are also pushed out by the second cut portion 63 of the insulation, therefore, no shielding wires 7 remain between the exposed insulated conductors 3, as shown in FIG. 1F.

Subsequently, exposed shielding wires 7 are cut off, leaving a certain length and they are bent back along insulation jacket 6 as shown in FIG. 1G. At this time, if the length L4 of the exposed shielding wire 7 after being cut off is shorter than the length L3 of the second cut portion 63 of the insulation, the shielding wires 7 cannot reach the insulated conductors 3 by crossing over the second cut portion 63 even if the bent back shielding wires spring back. Therefore, contact between the shielding wires and the signal conductors can be absolutely prevented. Further, during the performance of the operations shown in FIGS. 1D to 1G, since the ends of the exposed insulated conductors 3 and the drain conductors 4 are covered and retained in position by the first cut portion 62 of the insulation jacket, the alignment of conductors 3 and 4 is maintained. Accordingly, when the insulation 2 at the ends of insulated conductors 3 is removed as shown in the FIG. 1H, the insulated conductors can then be connected with terminals of an electrical connector.

Figure 2:
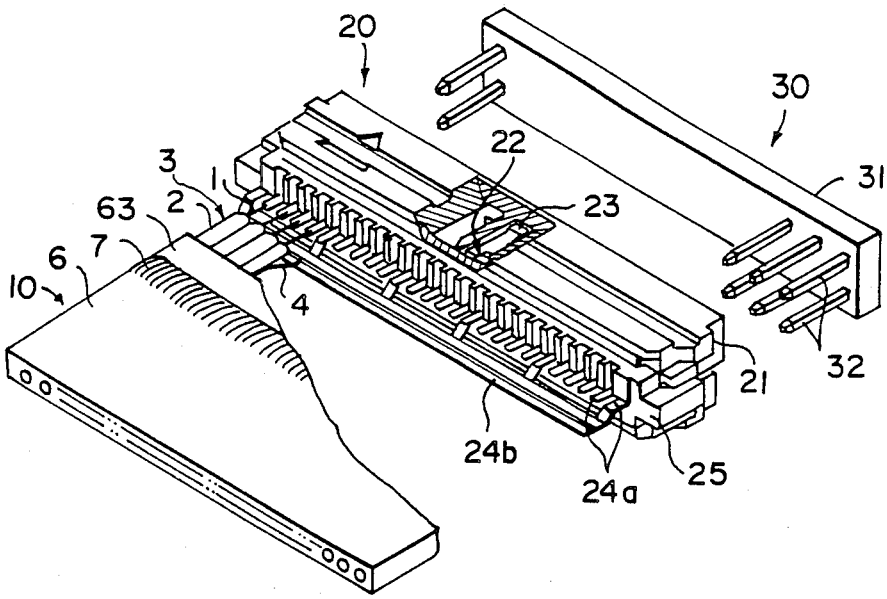
FIGS. 2 and 3 are a perspective view and a cross-sectional view respectively of the shielded cable according to this invention connected to an electrical connector.
Figure 3:
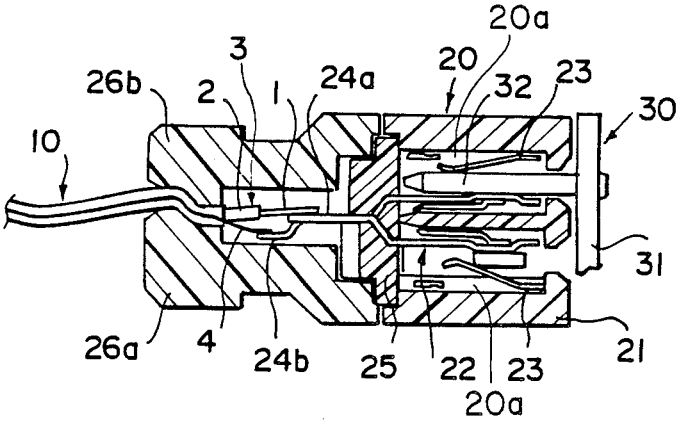

FIGS. 2 and 3 show conductors 1, 4 of shielded cable 10 prepared as described above electrically connected with terminals of electrical connector 20. Connector 20 comprises a plurality of electrical terminals 22 arranged laterally and retained in position within a dielectric retaining member 25. A dielectric housing 21 receives and retains receptacle sections 23 at one end of terminals 22 in passages 20a thereof. Upper and lower dielectric cover members 26*a* and 26*b* are fitted to housing 21. Upper and lower cover members 26*a* and 26*b* are not shown in FIG. 2. Retaining member 25 is positioned at the rear portion of housing 21, and terminating sections at the other end of terminals 22 project backward from retaining member 25. Some of terminating sections 24*a* are used for ground, and are linked with ground bus 24*b* extending downward.

To connect the shielded cable 10 with connector 20, first upper and lower cover members 26*a* and 26*b* are removed from housing 21 and each of the signal conductors 1 of the shielded cable 10 are connected with respective terminating sections 24*a*, then all of the drain conductors 4 are connected with ground bus 24*b*. Upper and lower cover members 26*a* and 26*b* are then fitted to housing 21, to cover the terminations of conductors 3 to terminating sections 24*b* and conductors 4 to ground bus 24*b*. Cable 10 is engaged by upper and lower cover members 26*a* and 26*b* as shown in FIG. 3 thereby providing a strain relief for shielded cable 10 thus protecting the terminations of signal conductors 1 and drain conductors 4 respectively to terminating sections 24*a* and ground bus 24*b* from the affect of any pulling force on cable 10.

Connector 20 as shown in FIGS. 2 and 3 is electrically connected with a mating electrical connector 30 after the connector 20 is connected to the prepared end of shielded cable 10. Electrical connector 30 comprises a plurality of electrical posts 32 secured in a dielectric member 31 and having a spacing corresponding to the spacing of receptacle sections 23 of terminals 22 secured in passages 20*a* of housing 21. Therefore, when the connector 20 is mated with connector 30, posts 32 are electrically connected with receptable sections 23 as shown in FIG. 3. Posts 32 are typically electrically connected to conductive paths of a printed circuit board or they can be electrically connected in plated through holes in a printed circuit board or multilayer circuit board.

According to this invention, since the exposed shielding wires 7 are held between the second cut portion 63 of the insulation jacket 6 and the remaining outer insulation jacket 6, electrical contact between the shielding wires 7 and the signal conductors is prevented. Also, in this case, if the length of the exposed folded back shielding wires 7 is made shorter than the width of the second cut portion 63, shielding wires 7 cannot come into contact with the signal conductors by extending over the second cut portion 63 even if the shielding wires 7 spring back; therefore, contact between the shielding wires and the signal conductors is absolutely prevented. Further, during the preparation of the end of the shielded cable since the second cut portion 63 of the insulation jacket is moved back again after being first moved to the ends of conductors 3, 4, the shielding wires 7 remaining between the insulated conductors 3 can be pushed back toward the center of the cable, and no shielding wires will remain between the insulated conductors 3. Also, the first cut portion 62 of insulation jacket 6 is located at the exposed ends of the conductors 3, 4, therefore, this prevents the conductors from fraying, bending or being misaligned.

Figure 7:
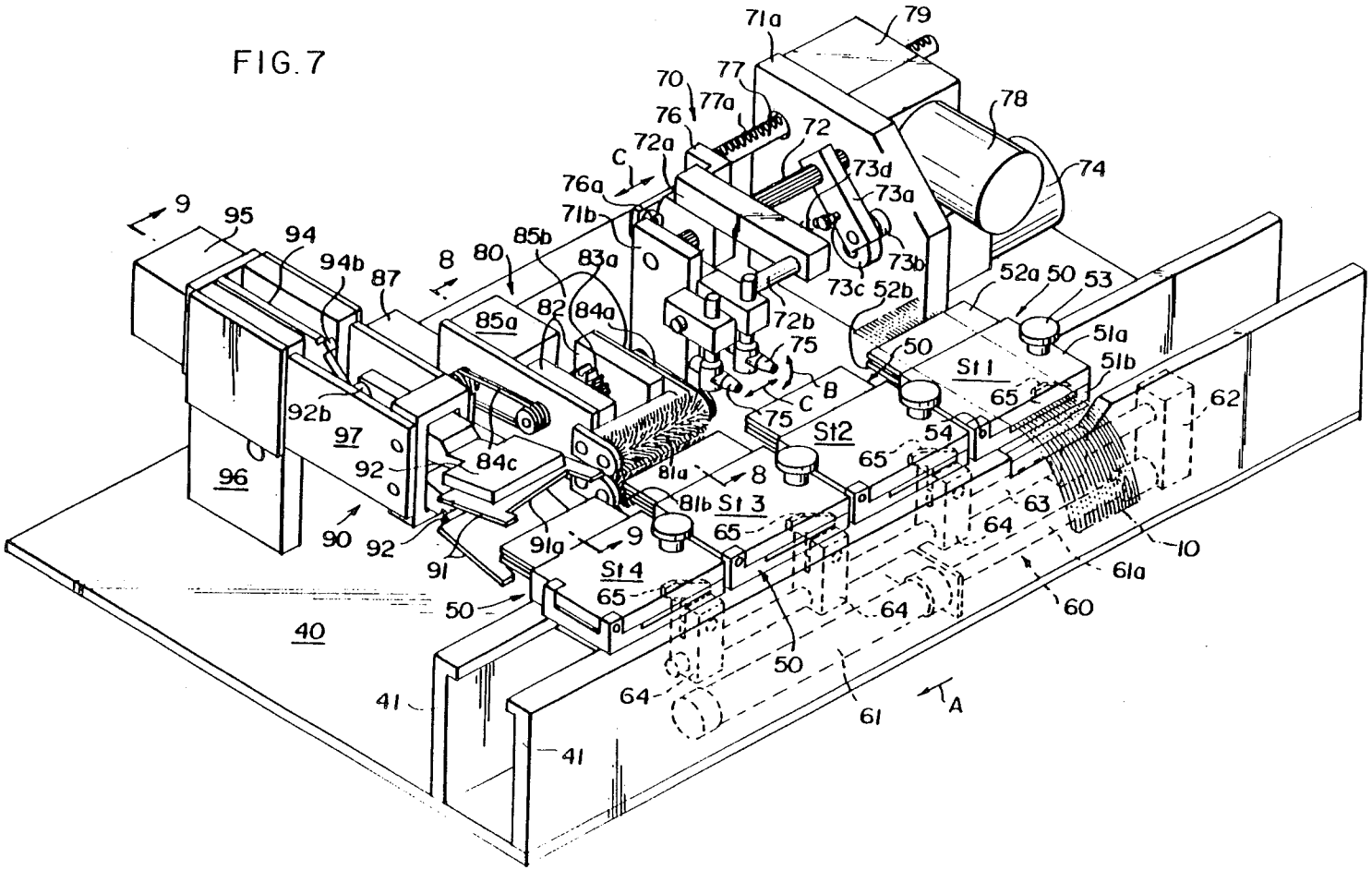
FIG. 7 is a perspective view of an apparatus for processing the end portion of a shielded cable in accordance with the present invention.

FIG. 7 shows the apparatus for processing the end portion of a shielded cable according to the present invention. The apparatus comprises a base plate 40, a pair of guiderails 41 extending along one edge of base plate 40, at least one cable holder means 50 (four are shown) mounted on rails 41 so as to be slidable therealong, a transport means 60 for sliding the cable holder means 50 along rails 41, a compressed air means 70 for separating shielding wires 7 into upper and lower rows, a wire-bending means 80 for bending back the upper and lower rows of shielding wires 7, and a wire-cutting means 90 for cutting the bent back shielding wires 7.

The cable holder means 50 has a pair of holder members 51*a*, 51*b* including respective retainer plates 52*a*, 52*b* and connected to each other via a shaft 54 such that the upper holder member 51*a* can be opened by means of a knob 53 connected thereto. After the upper holder member 51*a* has been swung open in this manner, the end portion of a shielded cable 10 is laid on the lower holder member 51*b* and the upper holder member 51*a* is closed again and clamped into position to clamp the cable 10 between the holder members 51*a*, 51*b*. The bottom of the cable holder means 50 engages with pawls 65 of a transport means 60 such that the cable holder means 50 is moved along the guiderails 41 by the movement of the pawls 65. The transport means 60 is arranged to move the cable holder member 50 so that it will proceed from right to left in FIG. 7 (in the direction of arrow A) successively stopping at each of four stations St1 to St4.

The transport means 60 has a transport cylinder 61 mounted on the base plate 40. A piston 61*a* of the transport cylinder 61 has at its distal end a connector block 62 which is connected with a transport rod 63. On the transport rod 63 are provided four transport blocks 64 each having spring-biased pawl 65 pivotally mounted at the top thereof. Thus when the piston 61*a* is moved to the right and left by the transport cylinder 61, the transport blocks 64 are also moved to the right and left.

During this movement the pawls 65 successively engage with the cable holder means 50, causing it to move successively from station St1 to station St4. More specifically, as shown in FIG. 7, the pawls 65 have pointed ends pointing to the left so that when they move left, they engage with the bottom of the cable holder means 50 but when they move right, they move past the cable holder means and do not engage therewith. As a result, the reciprocal left and right movement of the pawls 65 causes the cable holder means 50 to move to the left (in the direction of arrow A).

The compressed air means 70 is located behind the position occupied by the cable holder means 50 at station St2 and has a pair of nozzles 75 which are located opposite to the inner end of the cable holder means 50 at this station. The nozzles 75 are supported on a pair of support arms 72*a*, 72*b* and the support arm 72*a* is supported on a spline shaft 72 extending parallel to the guiderail 41. Support arm 72*a* is laterally slideable along spline shaft 72 which causes nozzles 75 to be also laterally movable. Spline shaft 72 is rotatably supported at its opposite ends by support plates 71*a*, 71*b* extending from base plate 40. Cam arm 73*a* is mounted on spline shaft 72, it has a cam follower 73*b* at its distal end and is urged downward by a spring 73*d*. Spring 73*d* holds cam follower 73*b* in contact with an eccentric cam 73*c* mounted on the rotary shaft of a cam drive motor 74. As a result, cam arm 73*a* is caused to reciprocate when eccentric cam 73*c* is rotated by cam drive motor 74, which in turn causes support arms 72*a*, 72*b* to also reciprocate and nozzles 75 to swing vertically (in the direction of arrow B). The rear end of support arm 72*a* is sandwiched between a pair of retainer blocks 76*a*, 76*b* (76*b* not being visible in FIG. 7) mounted on a movable block 76. Movable block 76 is connected with a rack bar 77 formed with a rack 77*a* on its upper surface. Rack bar 77 extends into a gear box 79 where rack 77*a* thereof engages with a pinion connected with the rotary shaft of a drive motor 78. Thus, depending on the direction of rotation of drive motor 78, the rack bar 77 is driven left or right. As a result, support arms 72*a*, 72*b* and nozzles 75 also move to the left or right (in the direction of arrow C).

Figure 8:
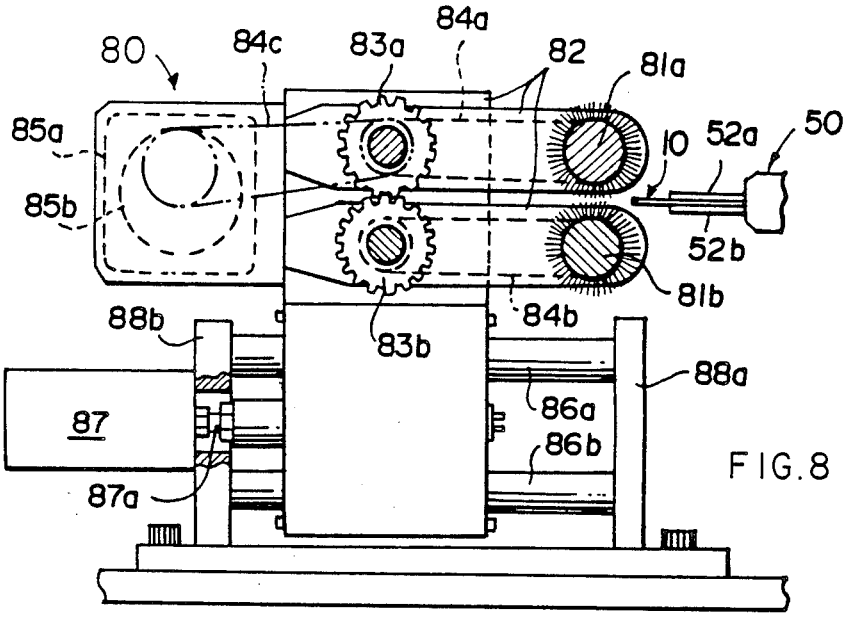
FIGS. 8 and 9 are cross-sectional views taken along line 8—8 and line 9—9, respectively, of FIG. 7.

Wire-bending means 80 is located at the position occupied by cable holder means 50 when it is at station St3. The structure of wire-bending means 80 will be explained with reference to both FIGS. 7 and 8. Wire-bending means 80 has upper and lower brushes 81*a*, 81*b* which are rotatably supported on a support block 82. Behind the brushes 81*a*, 81*b* are disposed gears 83*a*, 83*b* rotatably supported on support block 82 and engaged with each other. The upper brush 81*a* is linked with the upper gear 83*a* by a belt 84*a* and the lower brush 81*b* is linked with the lower gear 83*b* by a belt 84*b*. The upper gear 83*a* is further linked with a brush drive motor 85*b* via a belt 84*c* and a gear box 85*a*. With this arrangement, operation of the brush drive motor 85*b* causes the upper and lower brushes 81*a*, 81*b* to rotate in opposite directions. The lower portion of the support block 82 rides on a pair of guide rods 86*a*, 86*b* extending between a forward support plate 88*a* and a rearward support plate 88*b*. Support block 82 is therefore movable forward and backward. Support block 82 is further connected with a piston 87*a* of a brush feed cylinder 87 mounted on the rear surface of support plate 88*b*. As a result, brushes 81*a*, 81*b* are moved forward and backward together with support block 82 when piston 87*a* is extended and retracted by brush feed cylinder 87.

Wire-cutting means 90 is located at the position occupied by cable holder means 50 when it is at station St4. The structure of wire-cutting means 90 will be explained with reference to both FIGS. 7 and 9. Wire-cutting means 90 has a support plate 96 mounted on base plate 40 and a movable member 97 supported on support plate 96 so as to be movable in the forward and backward directions. Movable member 97 has a pair of blade holders 92 pivotally supported thereon by pins 92*a*. Blade holders 92 each supports one of a pair of opposed blade plates 91 at its forward end. Blade plates 91 have cutting edges 91*a* at their leading ends. Each of blade plates 91 is further provided with a roller 92*b* at its rearward end. In the normal state, the portions of blade holders 92 rearward of pins 92*a* are pulled toward each other by a spring 93 attached therebetween so that both the forward ends of blade holders 92 and blade plates 91 supported thereby are held open as shown in FIG. 7.

Figure 9:
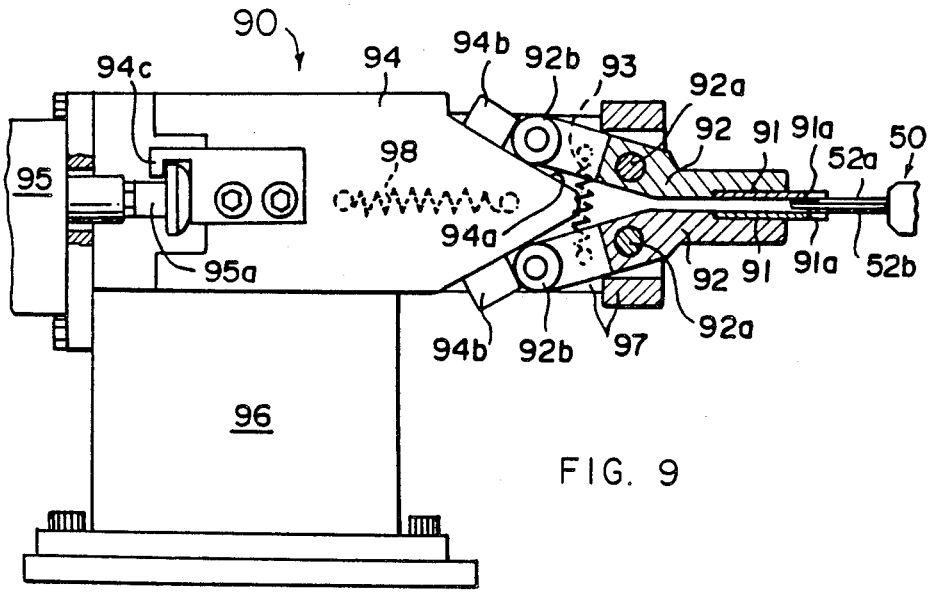

An arrow-shaped plate 94 is mounted on support plate 96 at a position rearward of blade holders 92 so as to be slidable in the forward and backward directions. The forward end of arrow-shaped plate 94 is formed as a pointed end 94*a* having upper and lower pusher projections 94*b*. At the rear end of arrow-shaped plate 94, an engagement hook 94*c* is located which engages with a piston 95*a* of a blade advance cylinder 95. Thus, when piston 95*a* is pushed forward by blade advance cylinder 95, arrow-shaped plate 94 advances causing end 94*a* to wedge between and force apart the rearward ends of blade holders 92, whereby blade plates 91 at the forward ends thereof are closed as shown in FIG. 9. The size of the gap between blade plates 91 when closed in this manner is equal to the combined thickness and spacing of retainer plates 52*a*, 52*b* of cable holder means 50. Thus, when arrow-shaped plate 94 is advanced still further by blade advance cylinder 95, pusher projections 94*b* come into abutment with rollers 92*b* of plate holders 92, whereby plate holders 92 are further advanced in the aforesaid closed state. As a result, retainer plates 52*a*, 52*b* are caught between blade plates 91.

When piston 95*a* of blade advance cylinder 95 is retracted, arrow-shaped plate 94 is retracted together therewith so that movable plate 97 to which plate holders 92 are attached is drawn back by a spring 98. Under the force of spring 98, blade holders 92 are thus drawn back to their original positions while, simultaneously, blade plates 91 at the forward end are opened to the position shown in FIG. 7 by the force of spring 93.

The steps by which the end portion of shielded cable 10 is prepared by the apparatus as described above will now be explained following the order of the various steps illustrated by FIGS. 1A to 1H.

First, only outer insulation jacket 6 is cut in the direction perpendicular to the axes of shielded insulated conductors 3 along a line running parallel to end 10*a* of cable 10 and set back from end 10*a* by a distance L1. Next, cut end portion 61 of outer insulation jacket 6 is removed, whereafter, as shown in FIG. 1B, the exposed portions of shielding wires 7 are unwound and divided into upper and lower rows, thus leaving only insulated conductors 3 and drain conductors 4 projecting out at end 10*a*. Then, as shown in FIG. 1C, the upper and lower rows of shielding wires 7 are cut.

Figure 10:
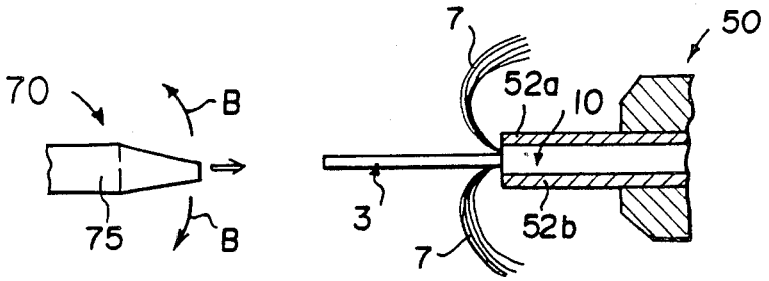
FIGS. 10 and 11 are respectively cross-sectional views showing the operations of a compressed air means and a wire-bending means used for carrying out the method of FIG. 1.

In accordance with this process, the unwinding of shielding wires 7 at the portion from which outer insulation jacket 6 has been removed, the separating of shielding wires 7 into upper and lower rows and the cutting of the separated rows of shielding wires is carried out continuously and automatically by the apparatus according to the present invention. Specifically, shielded cable 10 being removed of the cut portion 61 of outer insulation jacket 6 and having its shielding wires 7 exposed is clamped in cable holder means 50 positioned at station St1 in such a manner that the exposed elements of cable 10 projects forward. Cable holder means 50 is then transported to station St2 by transport means 60 so as to position the projecting exposed elements of shielded cable 10 opposite nozzles 75 of compressed air means 70. Cam drive motor 74 and drive motor 78 are then operated so as to cause nozzles 75 to move up and down (in the direction of arrow B) while at the same time moving back and forth (in the direction of arrow C). While nozzles 75 are performing this movement, air is blown out therefrom onto the exposed elements of shielded cable 10, whereby shielding wires 7 are separated into upper and lower rows as shown in FIG. 10.

Figure 11:
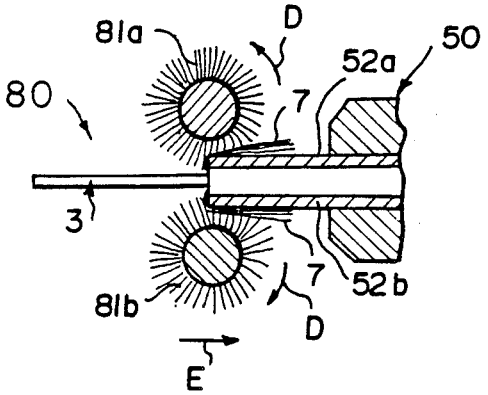

Next, transport means 60 moves cable holder means 50 to station St3 and brush drive motor 85*b* of wire bending means 80 is operated so as to cause brushes 81*a*, 81*b* to rotate in opposite directions as indicated by arrows D in FIG. 11. At the same time, brush feed cylinder 87 is operated to cause rotating upper and lower brushes 81*a*, 81*b* to move forward (in the direction of arrow E), whereby the upper and lower rows of shielding wires 7 are bent back over upper and lower retainer plates 52*a*, 52*b*, respectively.

Figure 12A:
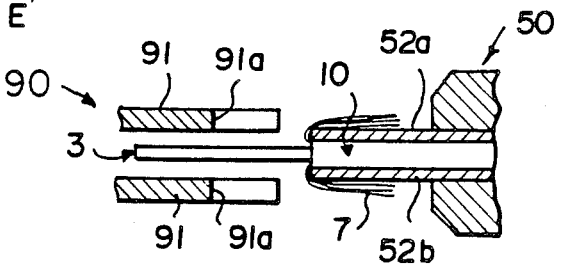
FIGS. 12A and 12B are cross-sectional views showing the operation of a wire-cutting means used for carrying out the method of FIG. 1.
Figure 12B:
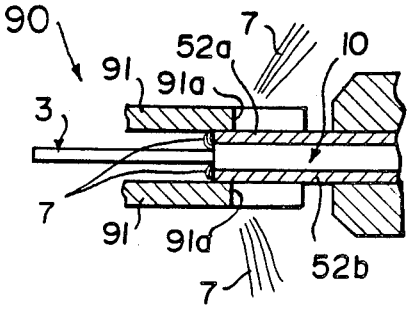

Next, transport means 60 moves cable holder means 50 to fourth station St4. Here arrow-shaped plate 94 of wire-cutting means 90 is pushed forward by blade advance cylinder 95 so that blade plates 91 are brought into their closed state at a position opposed to the end of shielded cable 10 as shown in FIG. 12A. Arrow-shaped plate 94 is then pushed further forward so that blade plates 91 advance until retainer plates 52*a*, 52*b* are located therebetween. Therefore, as shown in FIG. 12B, cutting edges 91*a* of blade plates 91 cut shielding wires 7 that have been bent back over retainer plates 52*a*, 52*b*.

While the foregoing description has been made with respect to the preparation of the end portion of a single shielded cable retained in a single cable holder means 50 as the cable holder means is conveyed through the first to fourth stations, the apparatus is designed to permit simultaneous use of a plurality of cable holder means positioned at the respective stations as shown in FIG. 7, whereby it becomes possible to carry out continuous processing of cable end portions.

Figure 4:
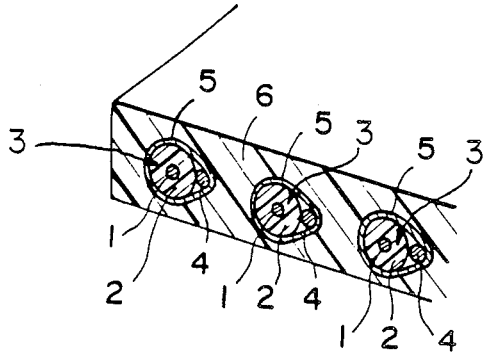
PRIOR ART FIG. 4
FIG. 4 is a cross-sectional perspective view showing a prior art shielded cable.

After shielding wires 7 have been cut in the manner just described, outer insulation jacket 6 is alone cut perpendicular to the axes of insulated conductors 3 along a line inward by a distance L2 from its outer edge as shown in FIG. 4C and the portion of outer insulation jacket 6 outward from this cut, i.e. a first cut portion 62, is shifted leftward along exposed conductors 3, 4 and shielding wires 7 to the ends of conductors 3, 4 and free of wires 7 as shown in FIG. 1D.

Next, the remaining portion of outer insulation jacket 6 is alone cut perpendicular to the axes of insulated conductors 3 along a line inward from what is now its edge by a distance L3 as shown in FIG. 1D and the cut portion 63 of outer insulation jacket 6 is moved leftward along exposed conductors 3, 4 and shielding wires 7 until it is free of wires 7 and abuts against the first cut portion 62 as shown in FIG. 1E. Second cut portion 63 is then moved in the reverse direction until it is moved adjacent to outer insulation jacket 6. As a result, exposed shielding wires 7 are pushed back by second cut portion 63 and, as shown in FIG. 1F, are disposed between second cut portion 63 and outer insulation jacket 6. It should be noted that at this time any of shielding wires 7 disposed between insulated conductors 3 will also be pushed to the right by second cut portion 63 so that when the state of the cable shown in FIG. 1F is achieved, there will be no shielding wires 7 will be remaining between insulated conductors 3 in the exposed portions thereof.

Shielded cable 10 is then clamped in cable holder means 50 at first station St1 of the apparatus shown in FIG. 7 and is subjected by the apparatus to separation, bending and cutting of shielding wires 7. The operations carried out by the apparatus at this time are the same as those described earlier and will not be explained again here. After shielding wires 7 have been cut, the remaining exposed portions thereof are laid back over the upper and lower surfaces of outer insulation jacket 6 as shown in FIG. 1H. At this time, if the length L4 of the exposed portion of shielding wires 7 after cutting is made smaller than the length L3 of second cut portion 63, there will be no possibility of any of shielding wires 7 springing back across second cut portion 63 and reaching insulated conductors 3. Contact between shielding wires 7 and signal conductors 1 is thus positively prevented. Further, since during the steps illustrated in FIGS. 1D to 1G, first cut portion 62 covers and holds in place the ends of insulated conductors 3 and drain conductors 4, the possibility of the spacing (pitch) among insulated conductors 3 and drain conductors 4 being disturbed is eliminated. Thus, once first cut portion 62 and insulation sheath 2 at the ends of insulated conductors 3 have been removed as shown in FIG. 1H, conductors 1, 4 are ready for connection to the respective terminals of connector 20 as hereinbefore described.

As has been explained above, in the preparation of the end portion of a shielded cable using the apparatus of the present invention, a predetermined length of the outer insulation jacket of the cable is removed beforehand to expose the insulated conductors, drain conductors and shielding wires, the shielded cable is clamped in cable holder means such that the exposed elements with the exposed shielding wires project forward opposite compressed air means which separates the shielding wires into upper and lower rows by blowing air thereonto, the exposed elements are moved opposite a wire-bending means which straightens and aligns the shielding wires and then bends them back over the upper and lower surfaces of the cable holder means, and the exposed elements are then moved opposite wire-cutting means which cuts off the upper and lower rows of shielding wires. By the use of this process, it is easy to automate the processing of the end portion of the cable. Moreover, since the preparation of the cable is carried out by first separating the exposed shielding wires of the shielded cable into upper and lower rows by blowing air thereon, then bending back the separated shielding wires, and finally cutting off the bent back shielding wires, little or no bending of the insulated conductors or drain conductors takes place and few if any of the shielding wires remain unwound from the insulated conductors.

We claim:

1. An apparatus for preparing an end portion of a shielded cable comprising a plurality of parallely disposed insulated conductors each comprised of a signal conductor surrounded by an insulation sheath, shields formed by spirally wound shielding wires around each of the insulated conductors defining shielded conductors and an outer insulation jacket integrally encasing all of the shielded conductors, the apparatus comprising:

cable holder means for holding the shielded cable;

transport means for moving the cable holder means through four stations, the shielded cable being removed along a predetermined length of the outer insulation jacket exposing shielded conductors beforehand and being clamped in the cable holding means at the first station such that the exposed shielded conductors project forward;

compressed air means opposite the position at which the exposed shielded conductors stops at the second station for blowing air onto the exposed shielded wires so as to separate them into upper and lower rows;

wire-bending means opposite the position at which the exposed shielded conductors stops at the third station for straightening and aligning the shielding wires separated by the compressed air and bending the shielding wires back over the cable holder means; and wire-cutting means, opposite the position at which the exposed shielded conductors stops at the fourth station for cutting the shielding wires bent back over the cable holder means, comprising a movable support having cutting-blade means pivotally mounted thereon, drive means for moving said movable support forward and rearward; operating means as part of said drive means for moving said cutting-blade means into position for cooperation with cable holder members of said cable holder means.

2. An apparatus as claimed in claim 1, wherein said cable holder means includes cable holder members pivotally connected together between which the cable is clampingly held thereby.

3. An apparatus as claimed in claim 1, wherein said compressed air means includes nozzle means for directing the compressed air onto the shielding wires.

4. An apparatus as claimed in claim 3, wherein operating means is connected to said nozzle means for moving said nozzle means in perpendicular directions.

5. An apparatus as claimed in claim 1, wherein said wire-bending means comprises brush means, means to drive said brush means so that they rotate in opposite directions, and means to move said brush means across cable holder members of said cable holder means and back again.

6. An apparatus for preparing an end of a shielded cable having signal conductors surrounded by insulation sheaths with shielding wires covering the insulation sheaths defining shielded conductors and an outer insulation jacket covering the shielded conductors and maintaining them in a planar array, an end section of the outer insulation jacket having been removed exposing the shielded conductors, said apparatus comprising:

base means;

cable-holding means mounted on said base means for clampingly holding the end of the shielded cable with the exposed shielded conductors extending outwardly therefrom;

transport means mounted on said base means operatively connected with said cable-holding means for moving said cable-holding means along said base means;

means mounted on said base means at a first station for separating the shielding wires into upper and lower rows;

wire-bending means mounted on said base means at a second station for bending the rows of shielding wires backwardly; and cutting means mounted on said base means at a third station for cutting the shielding wires, comprising cutting-blade means pivotally mounted onto movable support means, drive means for moving said movable support means forward and rearward, operating means for moving said cutting-blade means into position for cooperation with cable holder members of said cable-holding means for cutting the bent back shielding wires.

7. An apparatus as claimed in claim 6, wherein said separating means comprises compressed air means for blowing compressed air onto the shielding wires.

8. An apparatus as claimed in claim 7, wherein said compressed air means includes nozzle means and control means connected thereto to move said nozzle means in perpendicular directions.

9. An apparatus as claimed in claim 6, wherein said wire-bending means includes upper and lower brush means, drive means for driving said brush means in opposite directions, and means for moving said brush means forward and backward.

* * * * *